US008353688B2

(12) United States Patent
Navarro

(10) Patent No.: US 8,353,688 B2
(45) Date of Patent: Jan. 15, 2013

(54) VOLUMETRIC PUMP COMPRISING A DRIVING MECHANISM

(75) Inventor: Thierry Navarro, Gland (CH)

(73) Assignee: Swissinnov Product SARL (CH)

( * ) Notice: Subject to any disclaimer, the term of this patent is extended or adjusted under 35 U.S.C. 154(b) by 909 days.

(21) Appl. No.: 12/303,192

(22) PCT Filed: May 14, 2007

(86) PCT No.: PCT/IB2007/051812

§ 371 (c)(1),
(2), (4) Date: Dec. 2, 2008

(87) PCT Pub. No.: WO2007/141681

PCT Pub. Date: Dec. 13, 2007

(65) Prior Publication Data

US 2009/0196775 A1 Aug. 6, 2009

(30) Foreign Application Priority Data

Jun. 2, 2006 (WO) ..... PCT/IB2006/001623

(51) Int. Cl.

| | |
|---|---|
| ***F04B 37/00*** | (2006.01) |
| ***F04B 19/02*** | (2006.01) |
| ***F04B 27/06*** | (2006.01) |
| ***F04B 39/00*** | (2006.01) |
| ***F04B 53/00*** | (2006.01) |

(52) U.S. Cl. ..... 417/461; 417/460; 417/572

(58) Field of Classification Search ..... 417/457, 417/460, 493, 510

See application file for complete search history.

(56) References Cited

U.S. PATENT DOCUMENTS

| | | | | |
|---|---|---|---|---|
| 4,605,396 | A * | 8/1986 | Tseo et al. | 604/32 |
| 4,957,419 | A | 9/1990 | Rascov | |
| 5,174,472 | A | 12/1992 | Raque et al. | |
| 2005/0135954 | A1 * | 6/2005 | Saiki et al. | 417/572 |

FOREIGN PATENT DOCUMENTS

| | | | |
|---|---|---|---|
| FR | 2573487 | A1 | 5/1986 |
| FR | 2644851 | A1 | 9/1990 |
| WO | 2005017356 | A1 | 2/2005 |
| WO | 2006056828 | A1 | 6/2006 |

* cited by examiner

*Primary Examiner* — Anh Mai
*Assistant Examiner* — Zachary J Snyder
(74) *Attorney, Agent, or Firm* — Brooks Kushman P.C.

(57) ABSTRACT

A volumetric pump comprises at least one piston inside a cylindrical housing and means to cause a relative to-and-fro linear movement between the cylindrical housing and the piston in order to produce a stroke of the volumetric pump. This pump further comprises a bi-directional angular rotatable disc acting as a valve which connects alternately at least one inlet port and at least one outlet port to a least one pump chamber located inside the housing, and a driving mechanism arranged to dissociate at least partially the bi-directional angular movement of the rotatable disc with the to-and-fro linear movement of the housing. This driving mechanism is arranged such that the rotatable disc reaches an angular position at which it opens and/or closes the inlet and/or outlet ports when there is no relative to-and-fro linear movement between the cylindrical housing and the piston.

6 Claims, 12 Drawing Sheets

VOLUMETRIC PUMP COMPRISING A DRIVING MECHANISM

The present invention concerns a volumetric pump comprising a driving mechanism ensuring the delivery of precise amounts of fluids.

Piston pumps, which are part of the prior art, include generally a driving mechanism actuated by a rotor so as to transform the angular motion of said rotor into a bi-directional linear and angular movement of the piston. In one embodiment, WO2006/056828 discloses a volumetric pump comprising a first piston inside a first hollow cylindrical part. This pump has an inlet port through which a liquid can be sucked into a pump chamber during an instroke of the piston and an outlet port through which the liquid can be expelled during the outstroke of the piston. A second piston is positioned opposite to the first piston inside a second hollow cylindrical part, both cylindrical parts being assembled end-to-end facing each other to form a housing. A rotatable element which comprises the inlet and outlet ports is mounted midway inside said housing. Said element is arranged to be animated by a combined bidirectional linear and angular movement to cause relative to-and-fro sliding between the cylindrical housing and the pistons along the axis of said pistons while closing the inlet and outlet ports synchronically to ensure a continuous flow delivery.

The major drawback of this pump stems from the fact that a rotor transmits to the rotatable element a combined bidirectional linear and angular movement. As a consequence, the pistons are still moving relatively to the housing during the opening and the closing of the inlet and outlet ports thus producing a pump stroke that is not truly precise.

The aim of the present invention is to propose a volumetric pump comprising an improved driving mechanism, operated preferably by a single rotor, which ensures no pumping movement during the opening and/or the closing of the inlet and/or the outlet ports. Such pump allows a bigger valve commuting angle which authorizes designing smaller pump mechanisms and disposables. It also creates a more precise pump stroke, leading to a more accurate delivered volume of a fluid.

This aim is achieved by a volumetric pump such as set out in claim 1. This volumetric pump comprises at least one piston inside a cylindrical housing and means to cause a relative to-and-fro linear movement between the cylindrical housing and the piston in order to produce a stroke of the volumetric pump. This pump further comprises a bi-directional angular rotatable disc acting as a valve which connects alternately at least one inlet port and at least one outlet port to a least one pump chamber located inside the housing, and a driving mechanism is arranged to dissociate at least partially the bi-directional angular movement of the rotatable disc with the to-and-fro linear movement of the housing. This driving mechanism is arranged such that the rotatable disc reaches an angular position at which it opens and/or closes the inlet and/or outlet ports when there is no relative to-and-fro linear movement between the cylindrical housing and the piston.

The invention will be better understood thanks to the following detailed description of several embodiments with reference to the attached drawings, in which.

Figure 1:
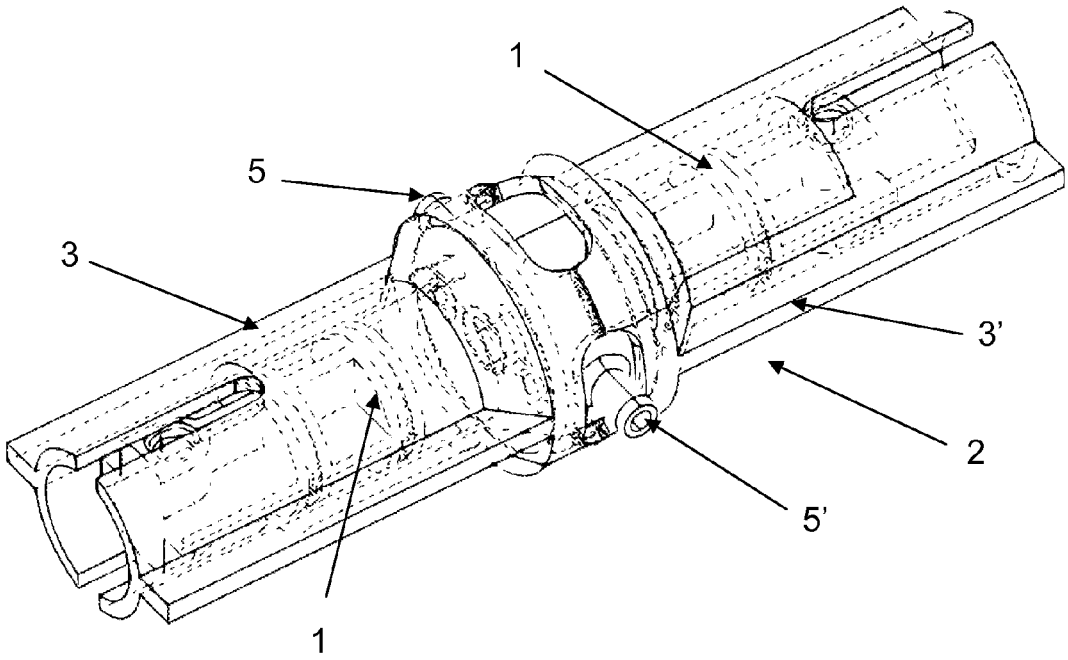
FIG. 1 represents a perspective top view of the volumetric pump in transparency without the driving mechanism
Figure 5A:
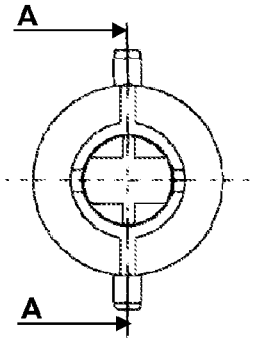
Figure 5B:
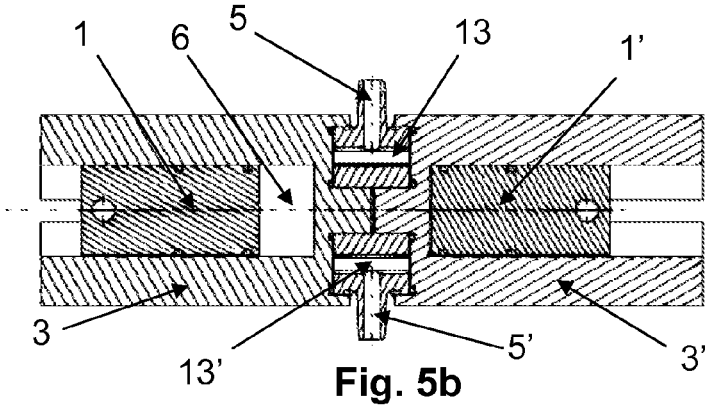

FIG. 5*a* represents an end view of FIG. 1 and FIG. 5*b* a cross-sectional view taken on the line A-A in FIG. 5*a* at the beginning of a cycle.

Figure 6A:
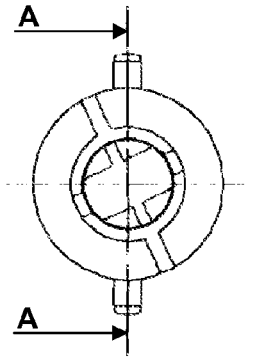
Figure 6B:
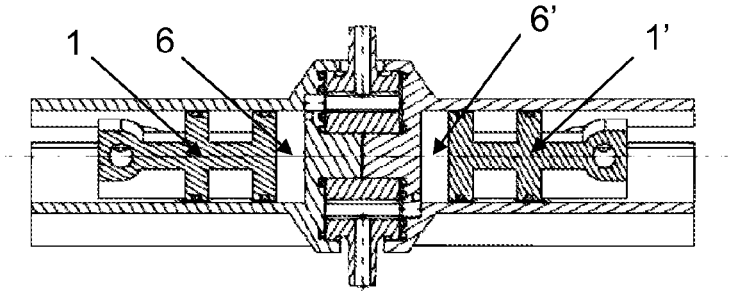

FIG. 6*a* represents an end view of FIG. 1 and FIG. 6*b* a cross-sectional view taken on the line A-A in FIG. 6*a* after a 90° rotation of a rotatable member which is part of the driving mechanism.

Figure 7A:
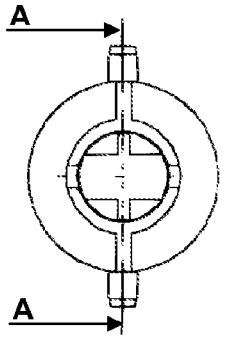
Figure 7B:
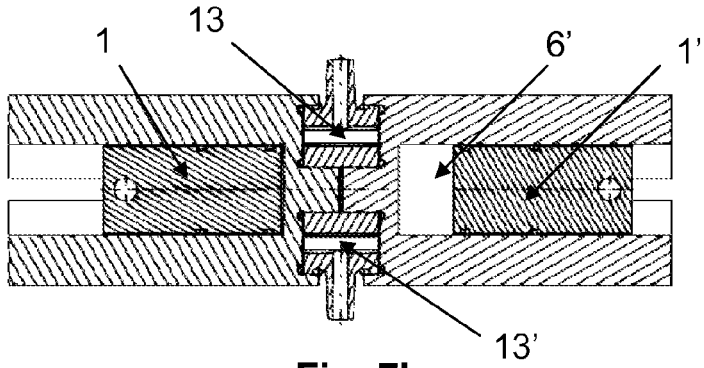

FIG. 7*a* represents an end view of FIG. 1 and FIG. 7*b* a cross-sectional view taken on the line A-A in FIG. 7*a* after a 180° rotation of the rotatable member.

Figure 8A:
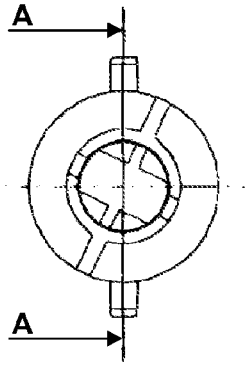
Figure 8B:
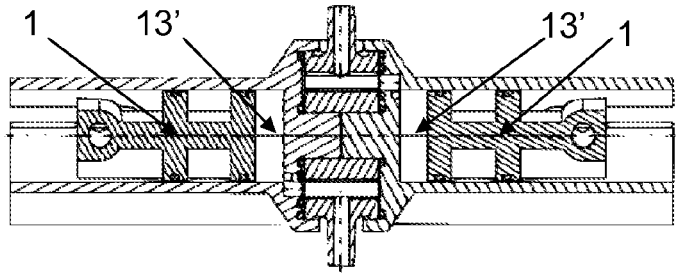

FIG. 8*a* represents an end view of FIG. 1 and FIG. 8*b* a cross-sectional view taken on the line A-A in FIG. 8*a* after a 270° rotation of the rotatable member.

Figure 9:
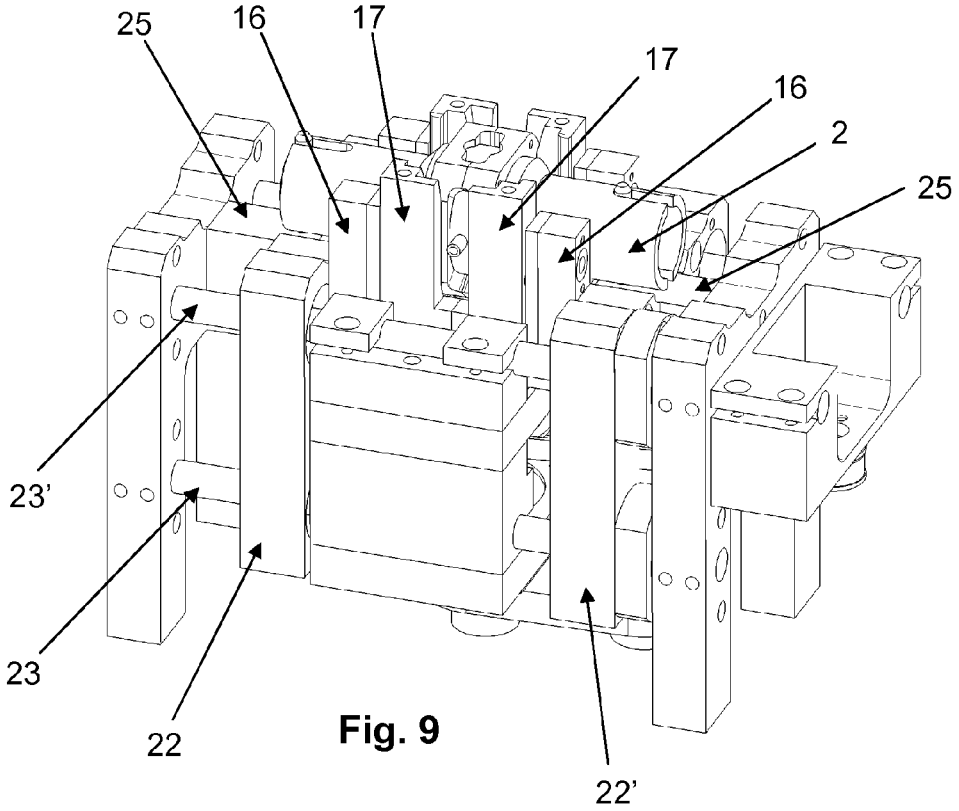

FIG. 9 represents a perspective view of the driving mechanism of the volumetric pump according to the first embodiment of the present invention.

Figure 10:
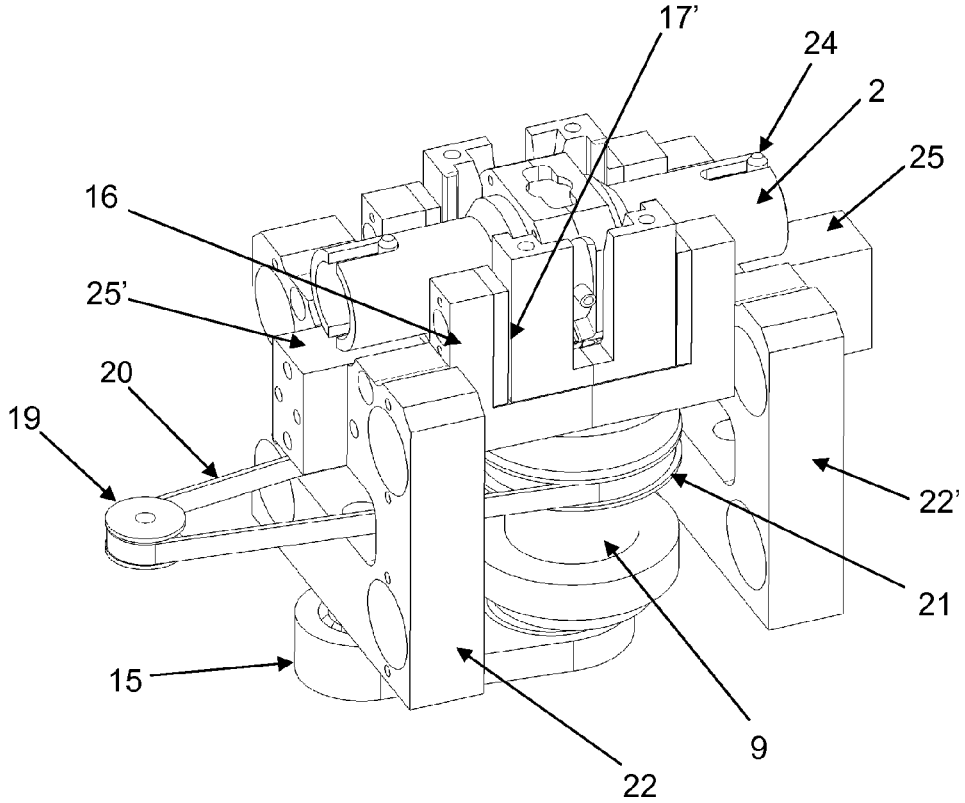

FIG. 10 represents a partial perspective view of the driving mechanism of FIG. 9.

Figure 11:
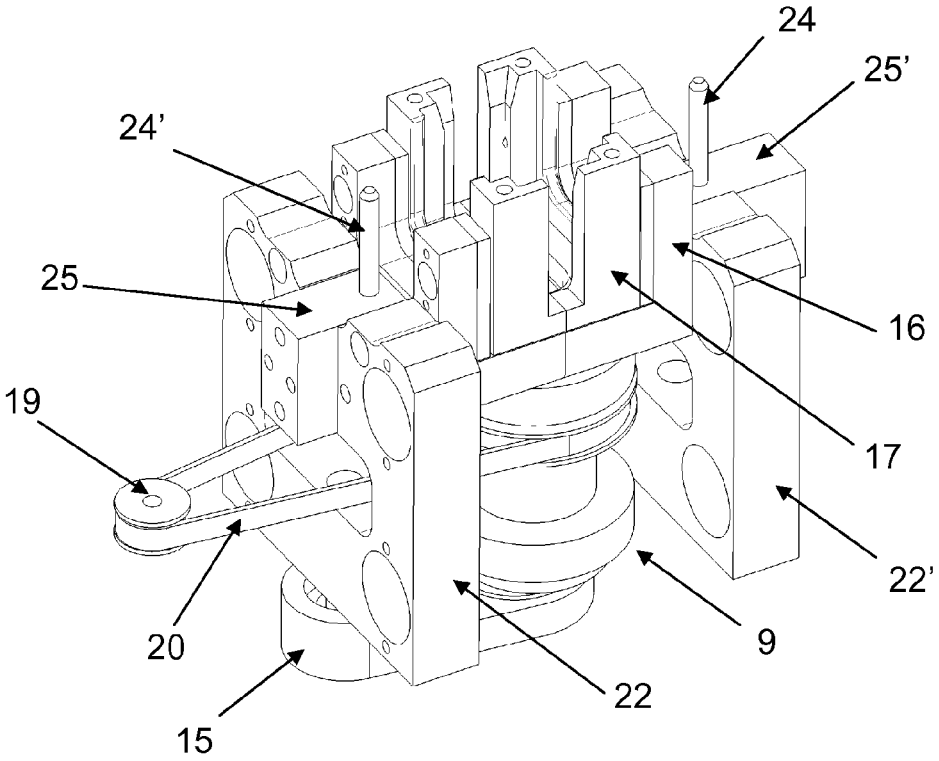

FIG. 11 represents a partial perspective view of the driving mechanism like FIG. 10 without the volumetric pump.

Figure 12:
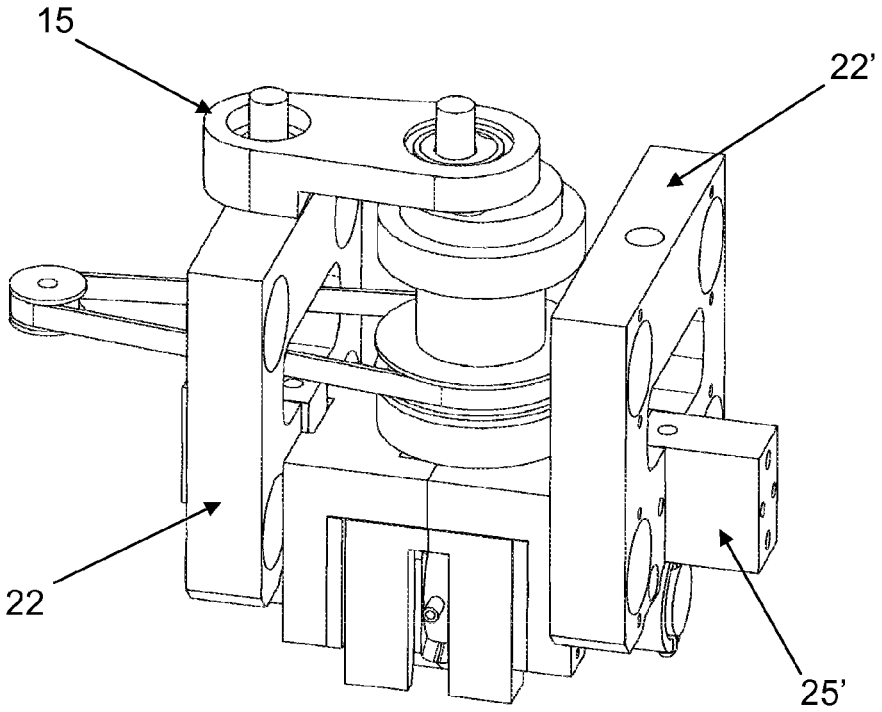

FIG. 12 represents a perspective bottom view of FIG. 11.

Figure 13:
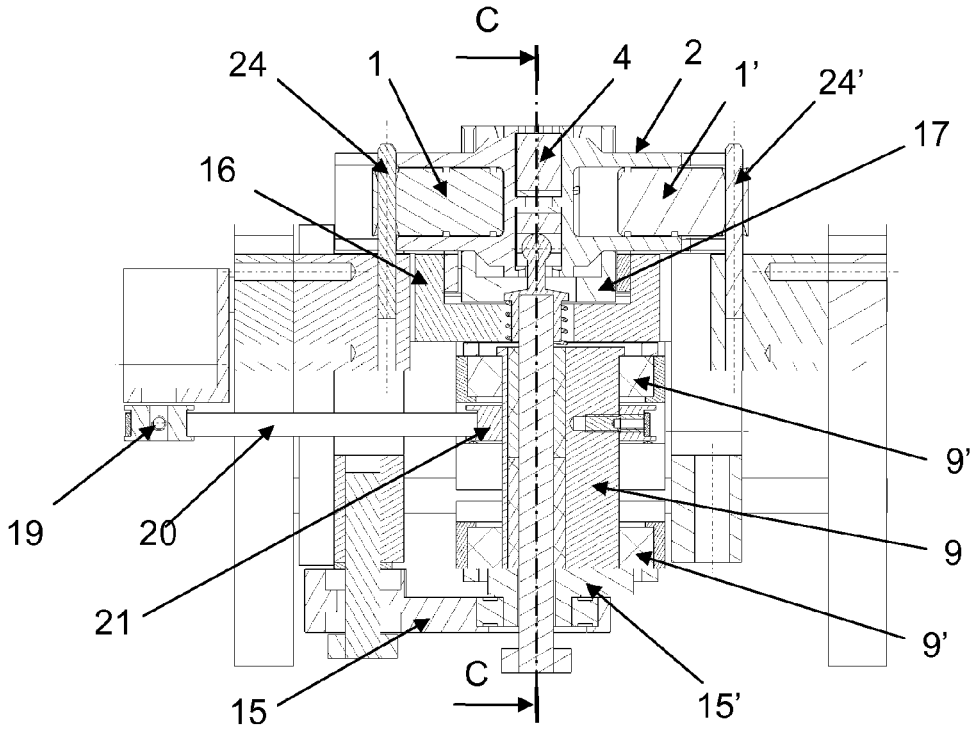

FIG. 13 represents a longitudinal cross-sectional view of FIG. 10.

Figure 14:
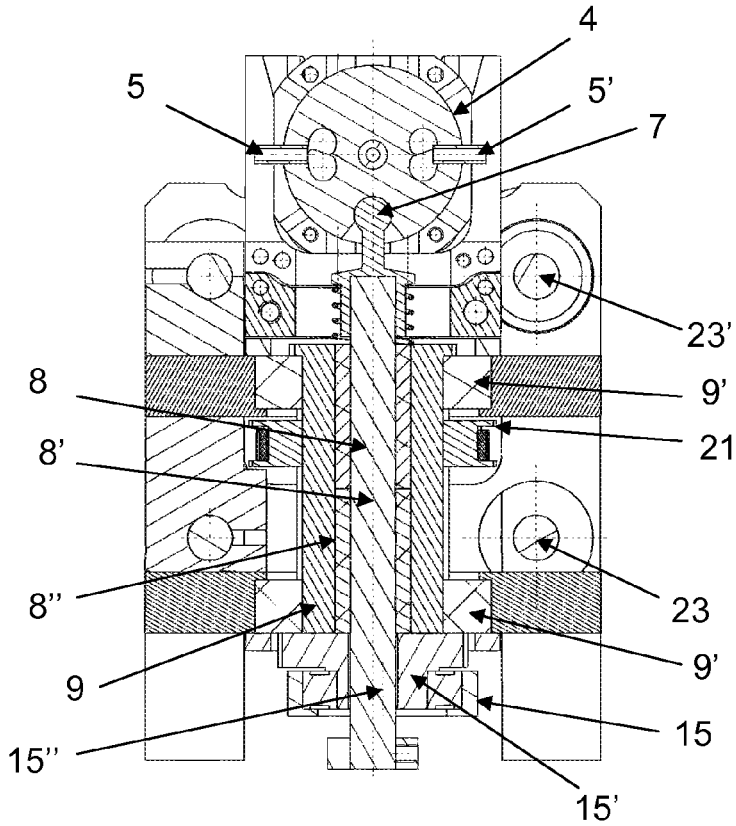

FIG. 14 represents a cross-sectional view taken on the line C-C of FIG. 13.

Figure 15:
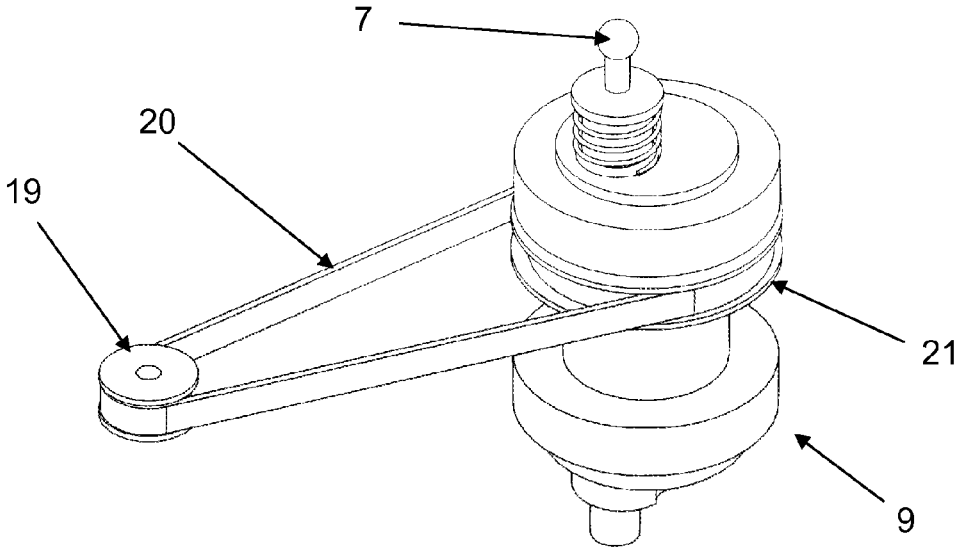

FIG. 15 represents a perspective view of the rotatable member whose angular movement is transmitted by a rotor through a transmission belt.

Figure 16:
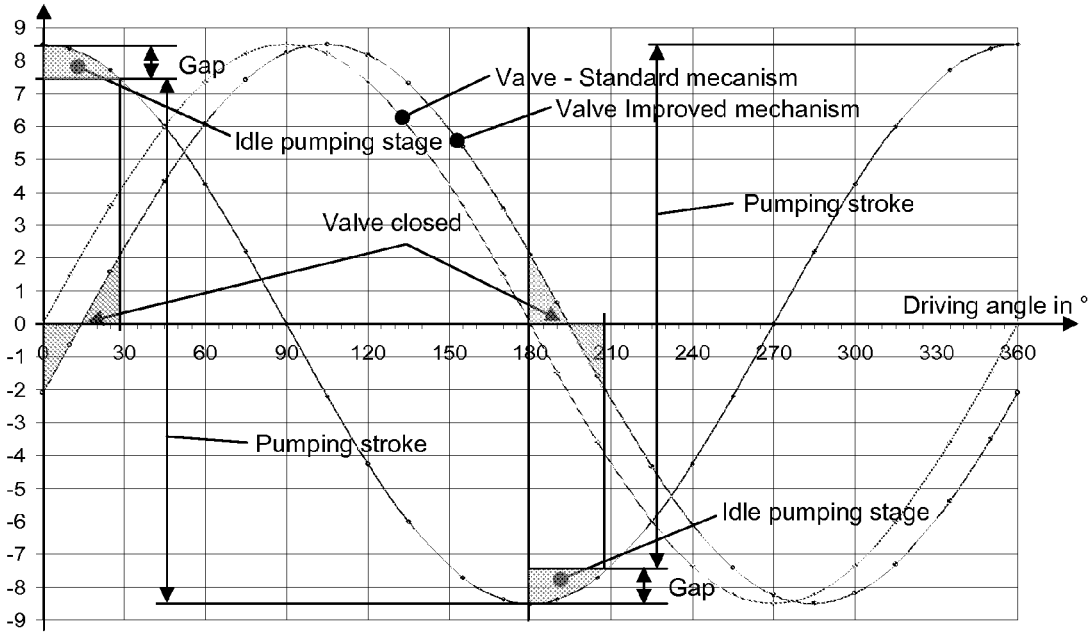

FIG. 16 represents a graph depicting the evolution of the valve sequence produced by the angular movement of the rotatable element of an improved mechanism over a standard mechanism relative to the magnitude of a pump stroke.

Figure 17:
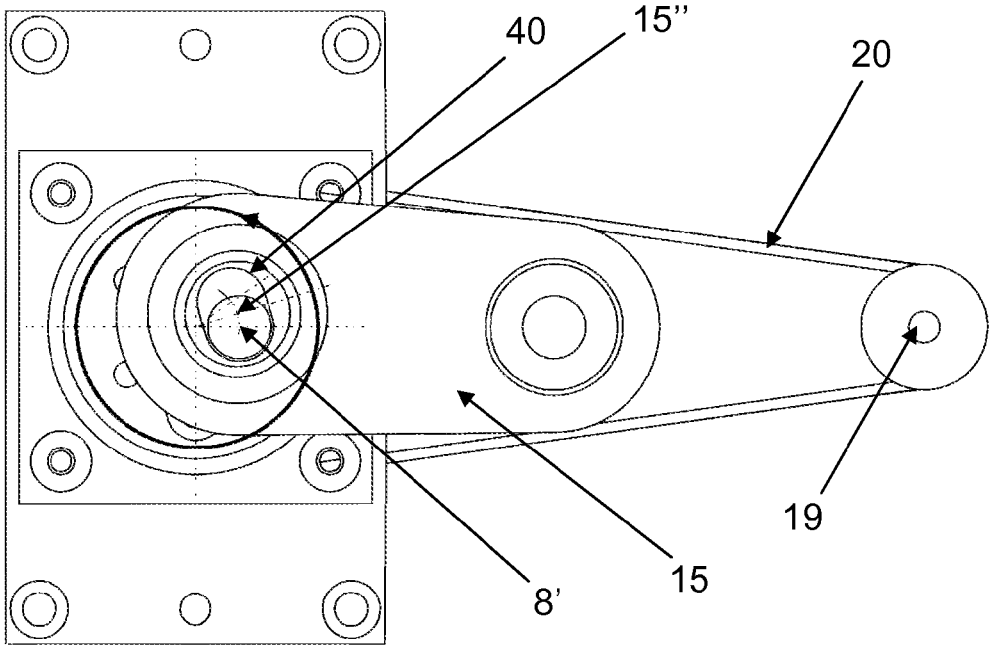

FIG. 17 represents a partial bottom view of the improved mechanism when the rotatable member is about to rotate anticlockwise.

Figure 18:
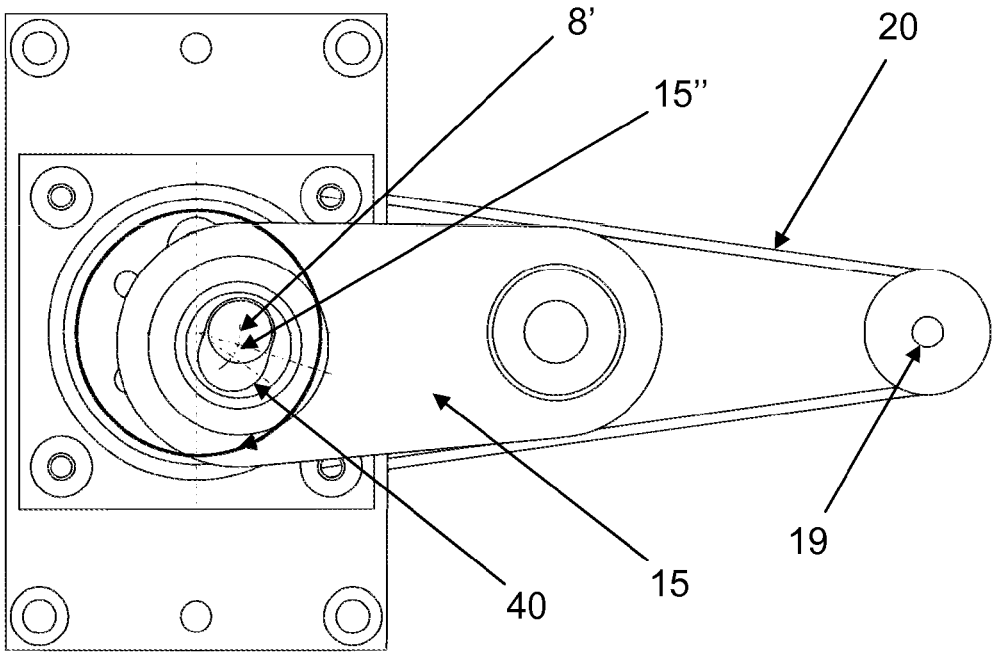

FIG. 18 represents a partial bottom view of the improved mechanism when the rotatable member is about to rotate clockwise.

Figure 19:
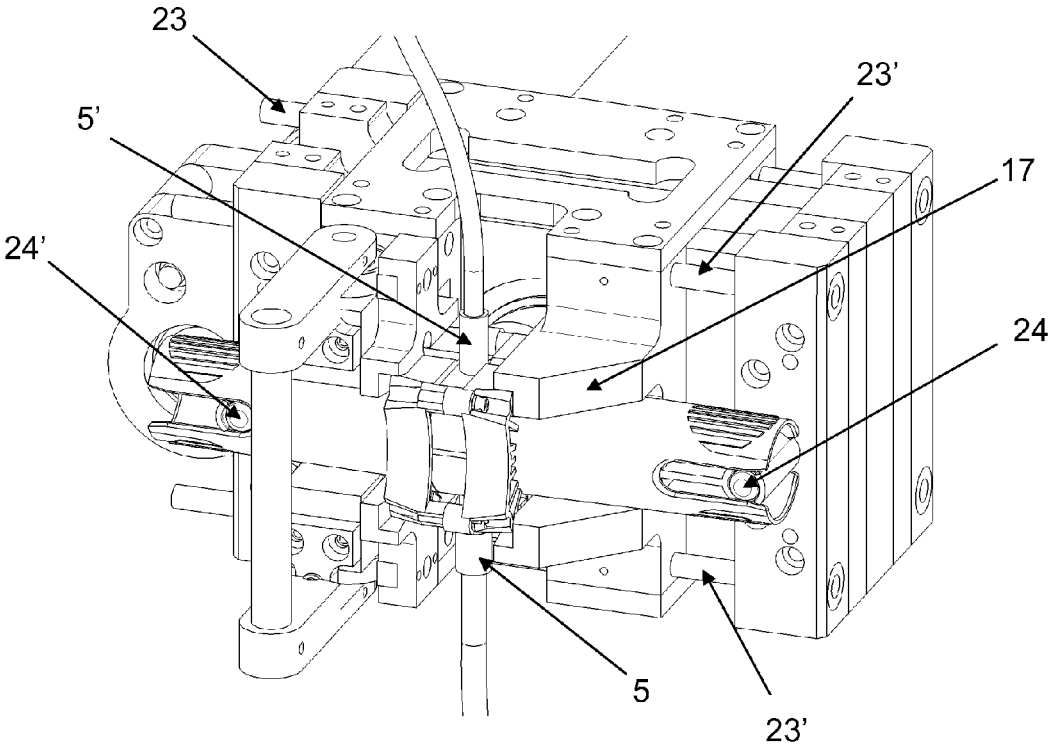

FIG. 19 represents a perspective view of the driving mechanism of the volumetric pump according to a second embodiment of the present invention.

Figure 20:
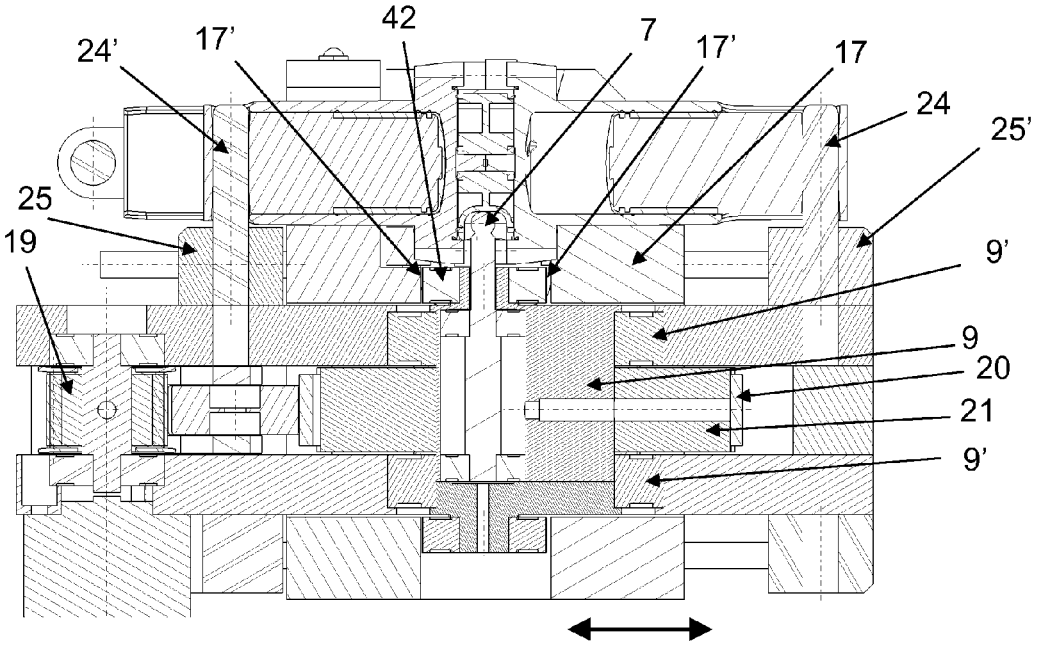

FIG. 20 represents a longitudinal cross-section view of FIG. 19.

Figure 21:
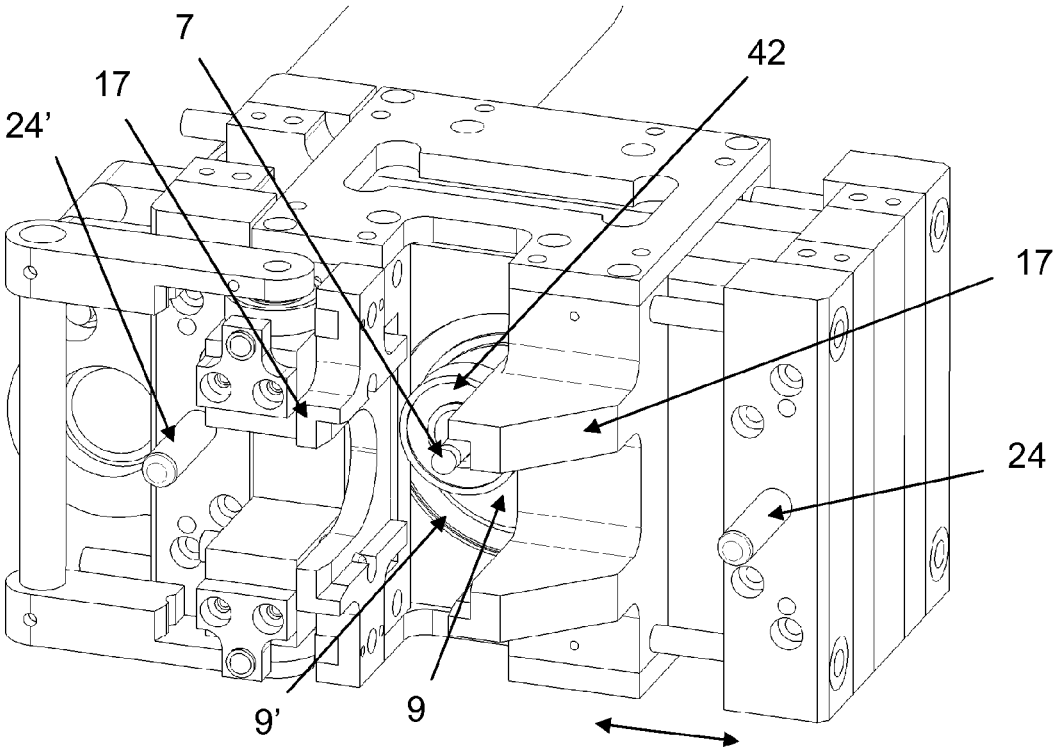

FIG. 21 represents a perspective view of the driving mechanism like FIG. 19 without the volumetric pump.

Figure 22:
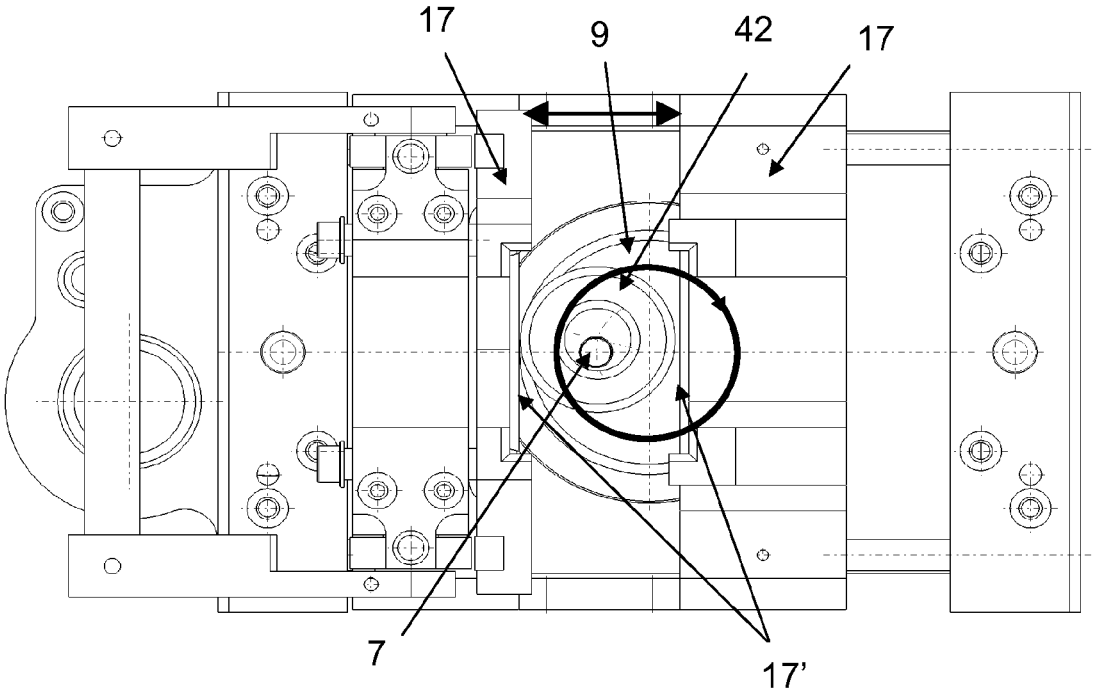

FIG. 22 represents a top view of FIG. 21.

Figure 23:
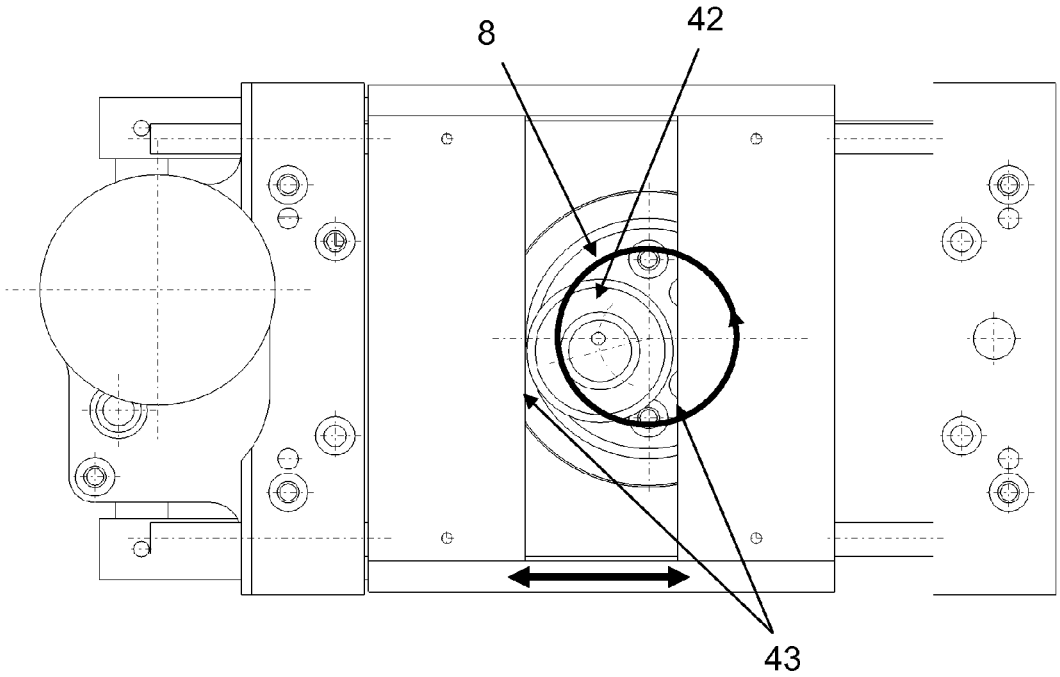

FIG. 23 represents a bottom view of FIG. 21.

Figure 24:
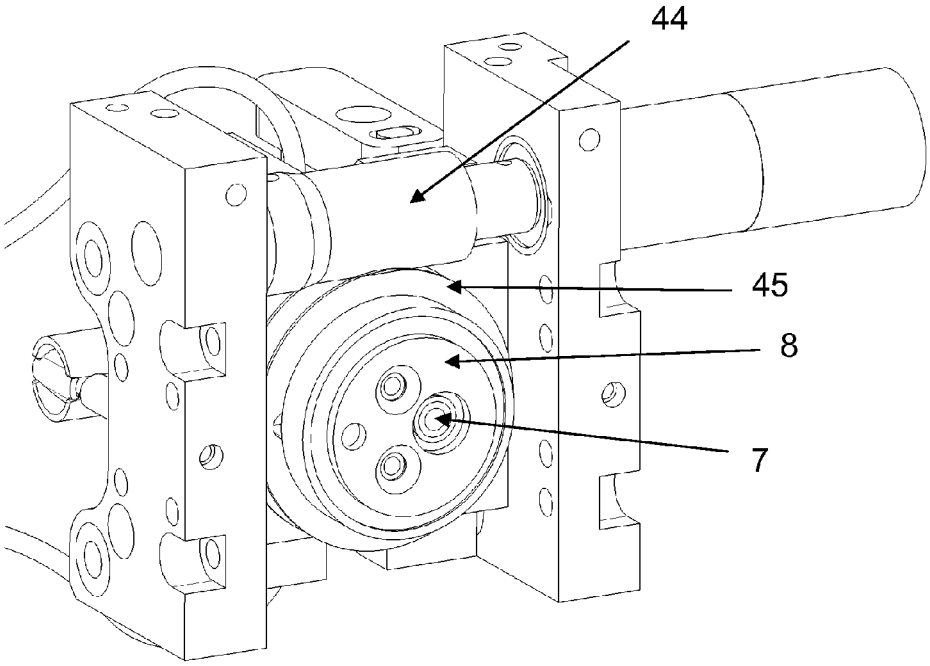

FIG. 24 represents a movement transmission from the rotor to the rotatable element according to a variant of the first two embodiments.

Figure 25:
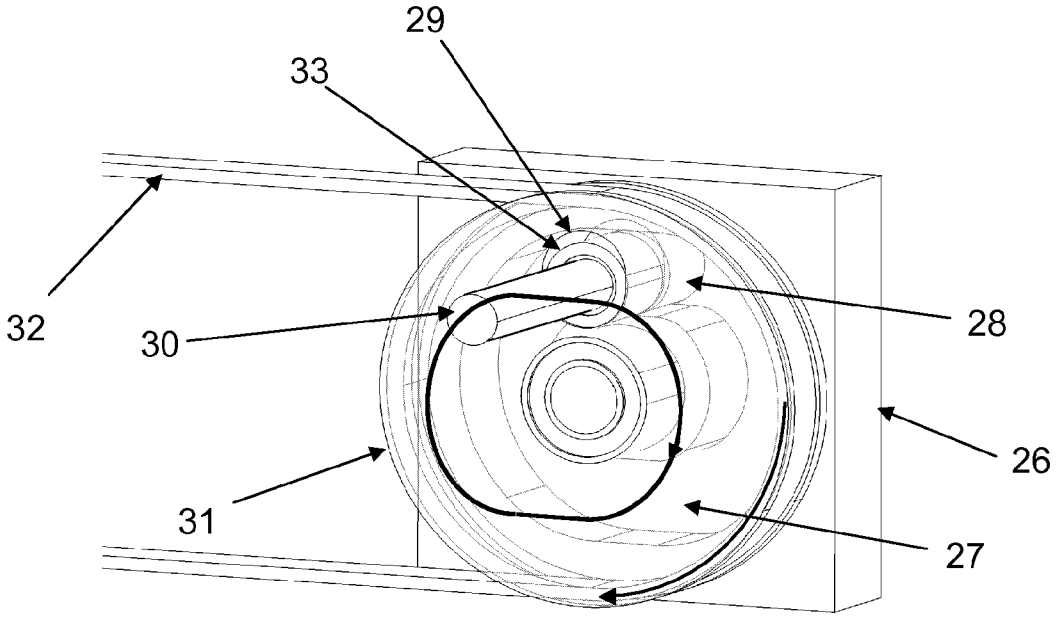

FIG. 25 represents a perspective view of the driving mechanism according to another embodiment of the present invention.

Figure 26:
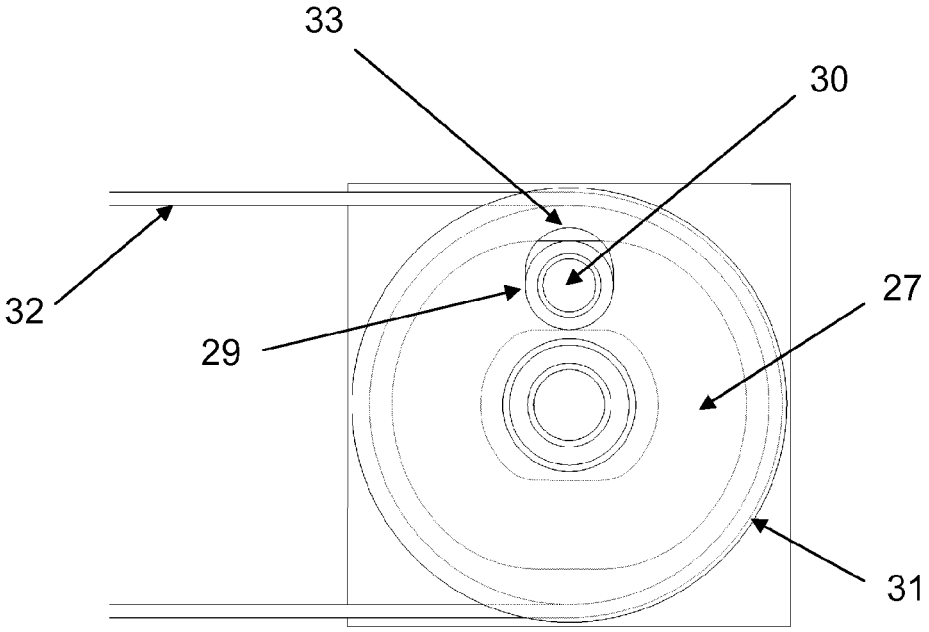

FIG. 26 represent a front view of FIG. 25.

According to a first embodiment of the invention, a pump, similar to the pump described in one embodiment of WO2006/056828, comprises a driving mechanism as described hereafter.

Figure 3:
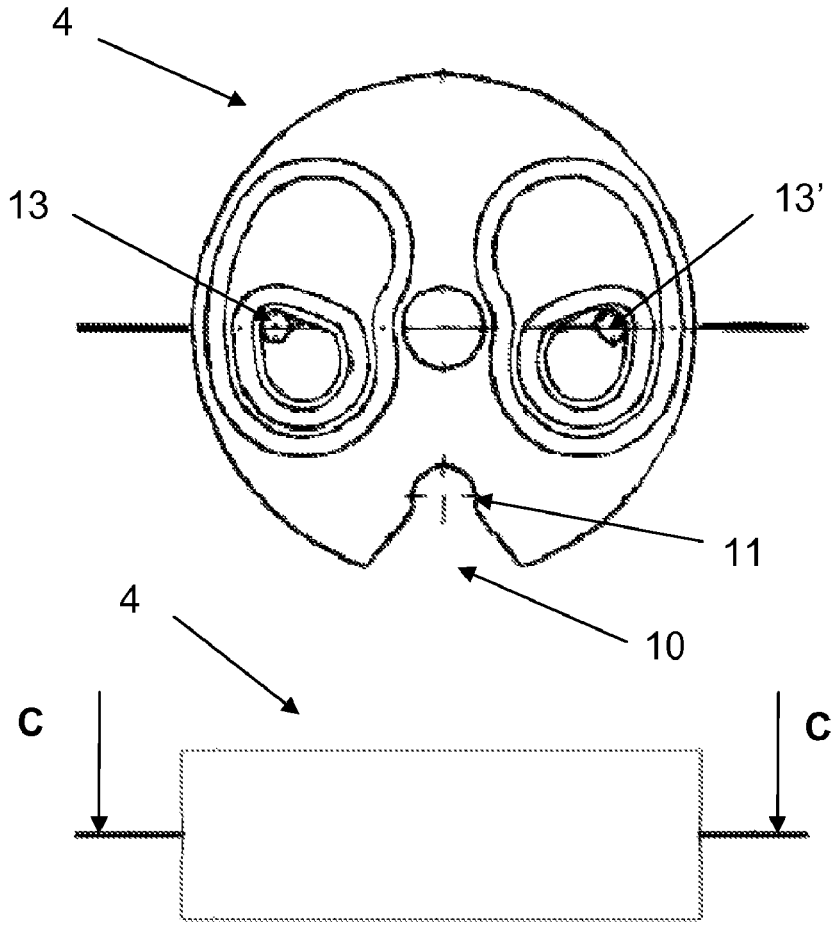
FIG. 3 represents a front view and a side view of the rotable disc.

Such pump comprises a first and a second piston (1, 1') fixedly positioned opposite to each other inside a hollow cylindrical mobile housing (2) as shown by FIG. 1. Said housing (2) is made up of two identical cylindrical parts (3, 3') assembled end-to-end facing each other. A disc (4) (FIGS. 3 and 4) comprising inlet and outlet ports (5, 5') located preferably at 180° from each other is mounted midway inside said housing (2) between the two cylindrical parts (3, 3'). Such assembly creates a first and a second chamber (6, 6'). The disc (4) is angularly movable relative to the housing (2) and actuated by the driving mechanism through a shaft as described later on.

Unlike the volumetric pump described in WO2006/056828 where the spherical extremity (7) of a shaft (8) is inserted into a hole located beneath the disc (4) in order to transmit a combined bi-directional linear and angular movement to said disc (4), the volumetric pump of the present invention comprises a disc (4) which has been modified so as to be adaptable to the driving mechanism of the present invention. Such disc (4) comprises on its bottom part an aperture (10) along its entire width, said aperture (10) having a half cylindrical-shaped recess (11) along which the spherical extremity (7) of the shaft (8), which is part of the driving mechanism, can slide while said driving mechanism is operating thus preventing the shaft (8) to transmit also a bidirectional linear movement to the disc (4) that would cause the housing (2) to slide to-and-fro along the axis of the piston (1, 1'). The bi-directional linear movement of the housing (2) along the axis of said pistons (1, 1') is transmitted by the driving mechanism as set out afterwards.

By the combined linear movement of the cylindrical housing (2) and angular movement of the disc (4), the cylindrical housing (2) slides back and forth following the axis of the two pistons (1, 1') while closing the inlet and outlet ports (5, 5') so as to ensure on the one hand an alternate sucking of a fluid from the inlet port (5) to respectively the first and second chamber (6, 6') and on the other hand an alternate expelling of the fluid (12) from respectively the first and second chambers (6, 6') to the outlet port (5').

Figure 2:
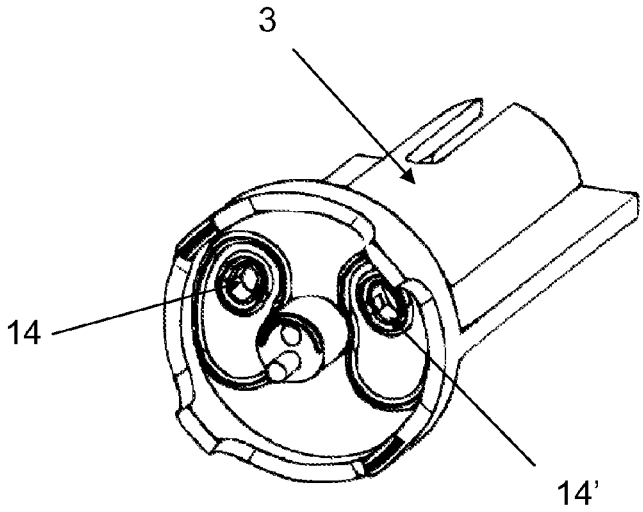
FIG. 2 represents a perspective view of one of the two cylindrical parts constituting the hollow cylindrical housing.
Figure 4:
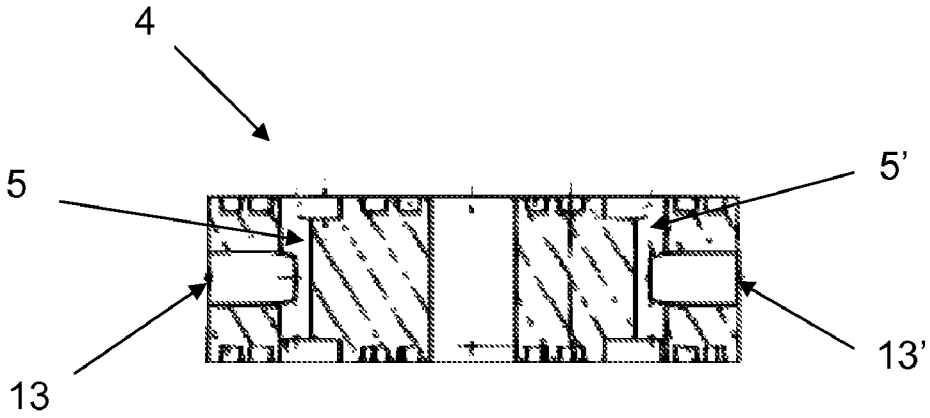
FIG. 4 represents a cross-sectional view of the rotable disc taken on the line C-C in FIG. 3.

The synchronisation of the suction and propulsion phases between the two chambers (6, 6') is achieved by first and second T-shaped channels (13, 13') located inside the disc (4) as shown by FIG. 4. Channels (13, 13') connect alternately the inlet port (5) to the first and second chamber (6, 6'), and the first and second chamber (6, 6') to the outlet port (5') when said channels (13, 13') overlap alternately a first and a second opening (14, 14') located on the end of both cylindrical parts (3, 3') as shown by FIG. 2 for the part (3).

To avoid any pumping movement when the inlet and/or outlet ports (5, 5') open or close, the driving mechanism comprises a rotatable member (9) contained by two ball bearings (9') (FIGS. 13 and 14). This rotatable member (9) is actuated by a rotor (19) which transmits through a transmission belt (20) an angular movement to a circular-shaped pulley (21) which is part of said rotatable member (9). The latter is transverse along its entire height by a shaft (8) positioned eccentrically. A liner and a rotation bearing (8") are mounted around the shaft (8) so that the latter can freely rotate about its own axis (8'). One extremity of the shaft (8) is adapted to transmit the bi-directional angular movement to the disc (4) of the volumetric pump as described above so as to open and close appropriately the inlet and outlet ports (5, 5') of said volumetric pump.

The driving mechanism further comprises a connecting-piece (15) which is connected at one end around a ring (15') whose axis (15") is angularly positioned forward to the shaft (8)'s axis (8'), the other end of said connecting-piece being connected to a first intermediate element (22). This connecting-piece (15) converts the rotating movement of the rotatable member (9) into a bi-directional linear movement of a block constituted of a cage (16) whose two sides are connected to the first and a second intermediate element (22, 22'). Each side of each intermediate element (22, 22') is slidably mounted on two parallel rods (23).

The cage (16) transmits the bidirectional linear movement to a movable support (17), the latter being slidably mounted inside the pump cage (16). The housing of the volumetric pump is fixedly adjusted into the support (17) while a shaft (24, 24') passes through each piston (1, 1') to fixedly connect said piston (1, 1') to a non-movable element (25, 25'). A lateral play (17') is provided between the pump cage (16) and said support (17) in order to delay the sliding movement of the support (17) and consequently the linear movement of the housing (2) of the volumetric pump.

The linear movement of the housing (2) along the pistons (1, 1') must be synchronized with the angular movement of the rotatable element (4) to ensure that there is no pumping movement during the opening and/or the closing of the inlet and/or outlet ports (5, 5') whatever be the initial position of the cage (16) and the direction of rotation of the rotatable member (9). FIG. 16 depicts the evolution of the valve sequence produced by the angular movement of the rotatable element (4) of an improved mechanism over a standard mechanism relative to the magnitude of a pump stroke. The commuting sequence of the valves, when operated with the improved mechanism, is represented by the shading areas located around the abscissa.

In order to coordinate the commuting sequence of the valves with the so called "Idle pumping stage" (FIG. 16) where no pumping movement occurs and which corresponds to the lateral play (17') which is provided between the pump cage (16) and said support (17) as described above, a play is provided by a groove (40) (FIGS. 17 and 18) in order to shift the sinusoidal curve from an angle such that the beginning of the closing sequence of the inlet or outlet ports (5, 5') occurs as soon as the volumetric pump reaches the end of a stroke. Such angle delays the closing and opening sequences such that they occur only during the idle pumping stage. This ensures that the complete opening sequence of the inlet or outlet ports (5, 5') occurs just before the next stroke produced by the sliding movement of the housing (2) along the other piston (1, 1'). With the standard mechanism the valves would still commute while the pumping movement would still occur, thus producing a pump stroke that is not truly precise.

This groove (40) creates a reversible mechanism which is independent both of the position of the pump cage (16) and the direction of rotation of the rotatable member (9) (FIGS. 17 and 18). This play is twice the angle required to complete an opening or a closing sequence of the inlet or outlet ports (5, 5').

As the shaft (8) is eccentrically mounted on the rotatable member (9), the bidirectional linear movement transmitted to the housing (2) of the volumetric pump is not constant as it follows a sinusoidal curve. In order to ensure a constant flow delivery, the driving mechanism must be put under servo to ensure constant linear movement.

In a second embodiment of the present invention (FIGS. 19, 20, 21, 22 and 23), the to-and-fro linear movement is transmitted directly by the rotatable element (9) to a part of the support (17) of the cylindrical housing (2) without the need of the connecting-piece (15), the first and second intermediate elements (22' 22') and the pump cage (16). Unlike the first embodiment, a ball bearing (42) is assembled around the upper part of the shaft (8) between two contact surfaces (43) part of the disposable supports (17). The distance between these two contact surfaces (43) is wider than the ball bearing (42) external diameter in order to create the lateral play (17') to make sure that no pumping movement occurs when the inlet and/or outlet ports (5, 5') open or close.

In a variant of the first and second embodiments of the present invention, the circular-shaped pulley (21) which is part of the rotatable member (9) is replaced by an elliptical-shaped pulley (not shown). The circumference of this pulley has been calculated so as to turn the inconstant linear movement of the housing (2) into a constant linear movement to ensure a constant flow delivery. The use of the elliptical-shaped pulley avoids putting the driving mechanism under servo.

In another variant of these two embodiments, the rotatable element (9) has an external toothed diameter (45) which meshes with a worm screw (44) directly driven by the rotor (19).

In a fourth embodiment of the invention (FIGS. 25 and 26), the driving mechanism comprises a stator (26) containing a square-shaped groove (27) having a specific radius on each corner. A first needle bearing (28) rests on the bottom of the groove (26) while a second needle bearing (29), into which a disposable shaft (30) is inserted, rests on the first one. A disc (31) is rotatably connected to the center of the stator (26) and is driven by a rotor (not shown) through a transmission belt (32). Said disc (31) has an aperture (33) through which the second needle bearing (29) is positioned. A lateral play between the second needle bearing (29) and the edge of the aperture (33) allows the disc (31) to drag the shaft (30) along the groove (27). The course of the shaft (30) is given by the first needle bearing (28) which rolls along the groove (27) while the disc (31) is dragging the second needle bearing (29) holding the shaft (29).

Although the present invention has been described with reference to specific embodiments, this description is not meant to be construed in limiting sense.

The invention claimed is:

1. A volumetric pump comprising:

at least one piston inside a cylindrical housing having a longitudinal axis;

a driving mechanism to cause a relative to-and-fro linear movement between the cylindrical housing and the piston along the direction of the axis in order to produce a stroke of the volumetric pump; and a bi-directional valve oscillatory rotatable about the axis which alternately connects at least one inlet port and at least one outlet port to at least one pump chamber located inside the housing;

the driving mechanism having an eccentrically rotatable shaft which cooperates with the bi-directional valve to oscillate the valve about the axis, the shaft further pivotally cooperating with a connecting-piece that drives one of the piston and housing to provide relative to-and-fro linear movement therebetween in timed relation to the movement of the bi-directional valve so that at least one of the inlet and outlet ports in the bi-directional valve are closed when there is substantially no relative movement between the piston and the housing, wherein the at least one piston comprises a first fixed piston inside a first hollow cylindrical part and a second fixed piston positioned opposite to the first piston inside a second hollow cylindrical part, both cylindrical parts being assembled end-to-end facing each other to form the housing, the valve being mounted midway inside the housing, said valve being angularly movable such that it connects the inlet port alternately to a first and second chamber into which a fluid can be sucked through a first channel during a pump instroke and further connects the outlet port alternately to said first and second chamber where the fluid can be expelled through a second channel during a pump outstroke, said pump instroke and outstroke being produced by the linear sliding movement of the housing along the pistons.

2. A volumetric pump comprising:

at least one piston inside a cylindrical housing having a longitudinal axis;

a driving mechanism to cause a relative to-and-fro linear movement between the cylindrical housing and the piston along the direction of the axis in order to produce a stroke of the volumetric pump; and a bi-directional valve oscillatory rotatable about the axis which alternately connects at least one inlet port and at least one outlet port to at least one pump chamber located inside the housing;

the driving mechanism having an eccentrically rotatable shaft which cooperates with the bi-directional valve to oscillate the valve about the axis, the shaft further pivotally cooperating with a connecting-piece that drives one of the piston and housing to provide relative to-and-fro linear movement therebetween in timed relation to the movement of the bi-directional valve so that at least one of the inlet and outlet ports in the bi-directional valve are closed when there is substantially no relative movement between the piston and the housing, wherein the driving mechanism comprises a single rotor transmitting through a transmission belt an angular movement to a pulley which is connected around the driving mechanism.

3. The volumetric pump according to claim 2, wherein the pulley of the driving mechanism has a circular shape.

4. The volumetric pump according to claim 2, wherein the pulley of the driving mechanism has an elliptical shape.

5. A volumetric pump comprising:

at least one piston inside a cylindrical housing having a longitudinal axis;

a driving mechanism to cause a relative to-and-fro linear movement between the cylindrical housing and the piston along the direction of the axis in order to produce a stroke of the volumetric pump; and a bi-directional valve oscillatory rotatable about the axis which alternately connects at least one inlet port and at least one outlet port to at least one pump chamber located inside the housing;

the driving mechanism having an eccentrically rotatable shaft which cooperates with the bi-directional valve to oscillate the valve about the axis, the shaft further pivotally cooperating with a connecting-piece that drives one of the piston and housing to provide relative to-and-fro linear movement therebetween in timed relation to the movement of the bi-directional valve so that at least one of the inlet and outlet ports in the bi-directional valve are closed when there is substantially no relative movement between the piston and the housing, wherein the valve defines an aperture, and the first end of the shaft includes a ball sized to fit within the aperture, such that eccentric movement of the shaft oscillatingly rotates the valve bi-directionally about the longitudinal axis of the housing.

6. The volumetric pump according to claim 5, wherein the aperture defines edges that correspond to a surface of the shaft adjacent to the ball, such that the oscillation of the valve causes the edges to contact the surface of the shaft and inhibit further oscillation of the valve.

* * * * *